US007293539B2

(12) United States Patent
Hayward et al.

(10) Patent No.: US 7,293,539 B2
(45) Date of Patent: Nov. 13, 2007

(54) ROCKER ARM ASSEMBLY

(75) Inventors: John S. Hayward, Torrington, CT (US); David Nguyen, Farmington, CT (US); Jerzy Baginski, Wethersfield, CT (US)

(73) Assignee: Timken US Corporation, Torrington, CT (US)

( * ) Notice: Subject to any disclaimer, the term of this patent is extended or adjusted under 35 U.S.C. 154(b) by 171 days.

(21) Appl. No.: 11/056,336

(22) Filed: Feb. 11, 2005

(65) Prior Publication Data

US 2006/0180109 A1 Aug. 17, 2006

(51) Int. Cl.
*F01L 1/18* (2006.01)

(52) U.S. Cl. ..... 123/90.39; 123/90.44; 74/569

(58) Field of Classification Search ..... 123/90.16, 123/90.2, 90.39, 90.41, 90.44; 74/559, 567, 74/569

See application file for complete search history.

(56) References Cited

U.S. PATENT DOCUMENTS 5,107,803 A * 4/1992 Furnivall ..... 123/90.16
5,195,475 A * 3/1993 Murphy et al. ..... 123/90.39
5,228,420 A * 7/1993 Furuya et al. ..... 123/90.38

* cited by examiner

*Primary Examiner*—Ching Chang
(74) *Attorney, Agent, or Firm*—Michael Best & Friedrich LLP

(57) ABSTRACT

A rocker arm assembly for mounting about a stud means. The rocker arm assembly generally comprises a rocker arm and a support member. The rocker arm has opposed first and second lateral ends and a central bore between the ends. The support member is positioned within the rocker arm central bore and mounted on the stud means. The rocker arm is configured to pivot about the support member. The support member has opposed lateral sides with a seal member extending along each lateral side. The seal members provide a seal between each lateral side of the support member and an internal surface of the central bore thereby providing more efficient oil lubrication to the ends of the rocker arm.

22 Claims, 2 Drawing Sheets

ROCKER ARM ASSEMBLY

BACKGROUND

The present invention relates generally to rocker arms and rocker arm assemblies in internal combustion engine drive trains.

In an internal combustion engine it is vital that all contacts and bearing surfaces be properly lubricated. If too little lubricant is supplied to these joints, the frictional forces created by their movement will not be overcome, leading to surface distress and eventual failure. Engine drive trains include rocker arms or levers and other moving parts which must be capable of rapid repetitive movement thousands of times each minute during high-speed operation.

The drive train of an internal combustion engine typically includes a number of reciprocating rocker arms or levers which operate to transmit the rotational movement of the camshaft to the reciprocal movement required to actuate the engine valves and/or fuel injectors. Lubricant, typically engine oil, may be supplied to each rocker arm from the engine oil supply in a variety of ways. Once the oil reaches the rocker arm, it is available to lubricate the rocker arm support surface and the rocker arm contact surfaces.

One method of lubricating the rocker arm components involves forming an open groove in the top of the rocker arm to channel lubricant to the joint contacting end of the rocker arm. Typical rocker arm bearings are lubricated during normal engine duty cycles by the pressurized oil traveling through pushrods and rocker arm ball socket openings. The oil pressure increases and decreases with the engine rpm. The varying engine speed and corresponding oil pressure creates a lubricating environment in the head ranging from oil traveling along the rocker arm lube rails at idle to squirting oil at higher speeds. During these higher speeds, the rocker arm working surfaces and bearings are lubricated by the oil splash. At lower speeds, the oil pressure is not sufficient to create an oil splash environment in the engine head. Certain engine applications, where these roller rocker arms are used, run at lower speeds for extended periods of time, and therefore, don't provide sufficient lubrication for the bearings.

SUMMARY

The present invention provides a rocker arm assembly for mounting about a stud means. The rocker arm assembly generally comprises a rocker arm and a support member. The rocker arm has opposed first and second lateral ends and a central bore between the first and second ends. The support member is positioned within the rocker arm central bore and mounted on the stud means. The rocker arm is configured to pivot about the support member. The support member has opposed lateral sides with a seal member extending along each lateral side. The seal members provide a seal between each lateral side of the support member and an internal surface of the central bore thereby providing more efficient oil lubrication to the ends of the rocker arm.

DETAILED DESCRIPTION OF THE PREFERRED EMBODIMENTS

The present invention will be described with reference to the accompanying drawing figures wherein like numbers represent like elements throughout. Certain terminology, for example, "top", "bottom", "right", "left", "front", "frontward", "forward", "back", "rear" and "rearward", is used in the following description for relative descriptive clarity only and is not intended to be limiting.

Figure 1:
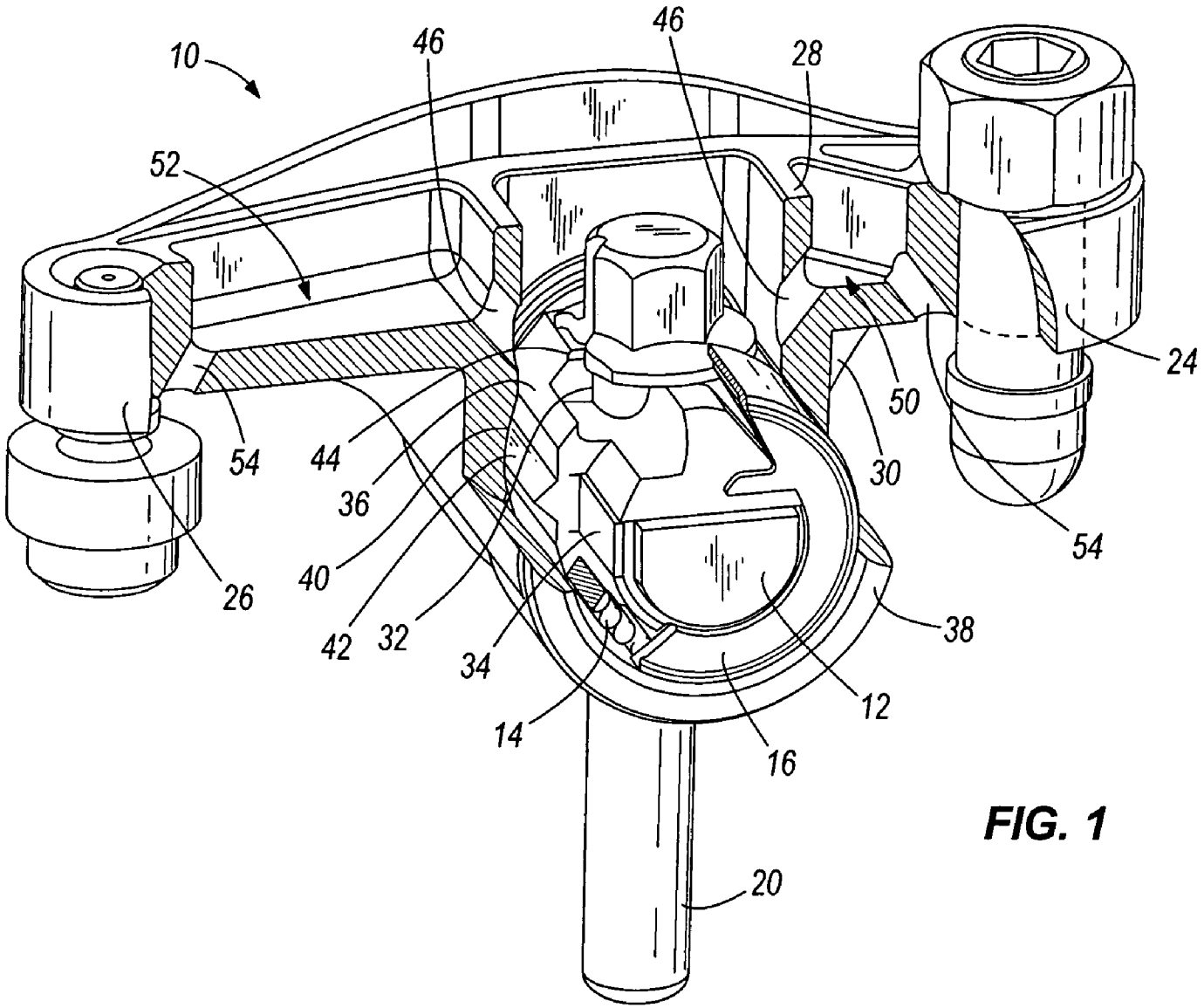
FIG. 1 is an isometric view, in partial section, of a rocker arm assembly according to a first embodiment of the present invention.

Referring now to the drawings, FIG. 1 illustrates a rocker arm assembly 2 that is a first embodiment of the present invention. The rocker arm assembly 2 generally includes rocker arm 10 supported on a bearing support member 12 by rolling elements 14 within an annulus between bearing cups 16 and the bearing support member 12. These elements form an assembly that can be mounted, for example, by a cap screw, bolt or other stud means 20 to a cylinder head of an internal combustion engine or the like.

Rocker arm 10 has a first end 24 for engagement with a push rod and a second end 26 for engagement with a valve stem of a poppet valve. In the embodiment shown, rocker arm 10 is of a cast configuration including reinforcing web 28 and flanges 30, providing added rigidity. However, the rocker arm assembly 2 of the present invention may be employed with stamped or cast rocker arms of various configurations.

The bearing support member 12 has a substantially vertical bore 32 for receiving stud means 20 to mount the rocker arm assembly. The bearing support member 12 has support arms 34 extending in opposite directions along a common axis perpendicular to stud means 20. Rolling elements 14 may be a full complement of needle rollers, as illustrated, or may employ other types of rolling members 14, with or without retainers.

The bearing cups 16 are rigidly mounted on two spaced apart side portions 38 of rocker arm 10, along the axis of bearing support member 12, by any of various fixing means. In the embodiment shown, for example, apertures in the side portions provide an interference fit with bearing cups 16. The bearing cups 16 preferably are configured to seal against the respective side portions 38 of the rocker arm 10 to prevent significant passage out of the rocker arm 10 past the area of the support arms 34.

The rocker arm 10 has a central bore 40 configured to receive the portion of the central portion 36 of the support member 12 between the support arms 34. Generally, the central bore 40 has a diameter larger than the diameter of the support member central portion 36 such that the support member 12 is free to rotate. In the present invention, wiper members 42 extend along each lateral side of central portion 36 of the support member 12. The wiper members 42 form a seal relative to the rocker arm central bore 40. The seal may be of the contact or non-contact type and may be formed integral with the support member or may include an insert composed of an alternate material to complete the seal. For example, the seal members 42 may be formed from natural or synthetic resilient materials. Additionally, the wiper member 42 configurations may be as shown or may be of any suitable configuration. The seal between the support member 12 and the rocker arm central bore 40 prevents draining away of oil from the bearings 14, 16 and the rocker arm ends 24, 26.

During engine operation, lubricating oil is continuously supplied to rocker arm assembly 2 by the engine's oil pump via a channel 44 in the support member 12. The seal between the wiper members 42 and the rocker arm central bore 40 retains a volume of the lubricating in the space within the central bore 40 above the wiper members 42. As the rocker arm 10 articulates during operation, the oil passages 46 in the rocker arm 10 move up and down relative to the wiper members 42. The volumes defined between the rocker arm central bore 40 and the wiper members 42 change in size as the rocker arm 10 articulates. The changing sizes displace the oil in these volumes and thereby force the oil to travel through the passages 46 and towards the passages 54 at the ends 24, 26 of the rocker arm 10 via channels 50 and 52, respectively. This provides direct lubrication during operation and significantly speeds-up lubrication during cold start-up.

Figure 2:
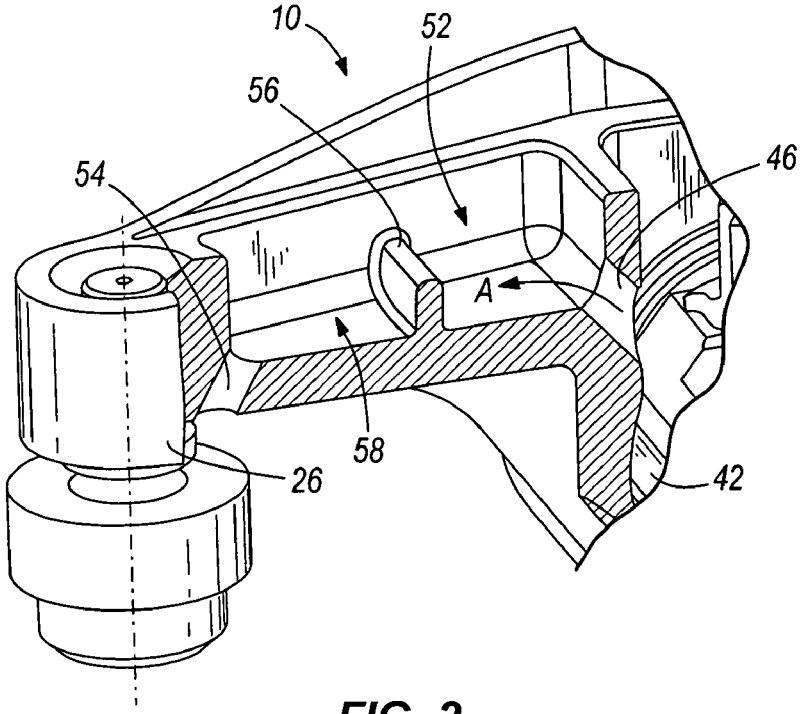
FIG. 2 is a partial isometric view, in partial section, of a rocker arm according to a second embodiment of the present invention.
Figure 3:
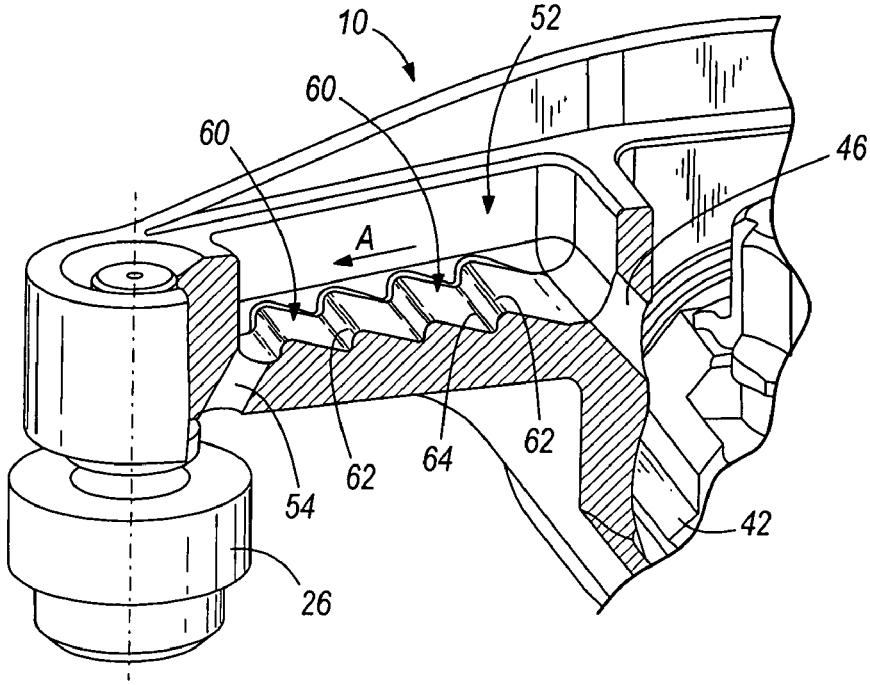
FIG. 3 is a partial isometric view, in partial section, of a rocker arm according to a third embodiment of the present invention.

To further speed up lubrication of the rocker ends 24, 26, reservoirs may be formed in each channel 50, 52 as illustrated in FIGS. 2 and 3. Referring to FIG. 2, the channel 52 is provided with a transverse wall 56 extending across the channel 52 perpendicular to the general direction of oil flow as indicated by arrow A. The transverse wall 56 defines an oil reservoir 58 at the rocker arm end 26 adjacent the passage 54. During operation, oil is pumped toward the rocker arm end 26. When the engine is stopped, the transverse wall 56 prevents oil in the reservoir from flowing back toward the rocker arm central bore 40. At start-up, oil in the reservoir will be readily available for flow to the end pivot points of the rocker arm 10 until pressure builds up through operation of the engine. Referring to FIG. 3, the channel 52 is provided with a series of angled steps 60. The steps 60 are configured such that they allow free flow of oil in the desired direction of oil flow as indicated by arrow A. At shutdown, the face 62 of each step 60 will prevent backflow of a portion of the oil, thereby creating a series of reservoirs 64 at each step face 62. Again, the oil in the reservoirs provides a readily available supply of oil at start-up and further does not inhibit flow during operation. While FIGS. 2 and 3 both show the reservoirs with respect to channel 52, channel 50 may also be provided with the transverse wall or angled steps to provide reservoirs in the channel 50.

Various modifications of the above-described embodiment of the invention will be apparent to those skilled in the art and it is understood that those modifications can be made without departing from the scope of the invention, if they are within the spirit and tenor of the accompanying claims.

What is claimed is:

1. A rocker arm assembly for mounting about a stud means, the rocker arm assembly comprising:

a rocker arm having opposed first and second lateral ends and a central bore between the first and second ends, the central bore having an internal surface;

a support member positioned within the rocker arm central bore and mounted on the stud means, the rocker arm configured to pivot about the support member, the support member defining an axis and having opposed lateral sides; and a seal member extending axially along each lateral side of the support member sealing each lateral side of the support member relative to the internal surface of the central bore.

2. The rocker arm assembly of claim 1 wherein a first fluid channel extends in fluid communication between the rocker arm central bore and the rocker arm first lateral end and a second fluid channel extends in fluid communication between the rocker arm central bore and the rocker arm second lateral end.

3. The rocker arm assembly of claim 2 wherein pivoting of the rocker arm relative to the support member causes the first and second fluid channels to move relative to the seal members thereby causing fluid contained by the seal members to be forced along the first and second fluid channels.

4. The rocker arm assembly of claim 2 wherein a transverse wall extends across the first fluid channel and thereby defines a fluid reservoir adjacent the rocker arm first lateral end.

5. The rocker arm assembly of claim 2 wherein a transverse wall extends across the second fluid channel and thereby defines a fluid reservoir adjacent the rocker arm second lateral end.

6. The rocker arm assembly of claim 2 wherein a series of angled steps extends across the first fluid channel, the steps having face surfaces directed toward the rocker arm first lateral end such that fluid traveling from the central bore toward the rocker arm first lateral end is generally unimpeded and a portion of oil attempting to travel from the rocker arm first lateral end toward the central bore is prevented by the face surfaces.

7. The rocker arm assembly of claim 6 wherein a series of angled steps extends across the second fluid channel, the steps having face surfaces directed toward the rocker arm second lateral end such that fluid traveling from the central bore toward the rocker arm second lateral end is generally unimpeded and a portion of oil attempting to travel from the rocker arm second lateral end toward the central bore is prevented by the face surfaces.

8. The rocker arm assembly of claim 1 wherein the seal members are formed integral with the support member.

9. The rocker arm assembly of claim 1 wherein the seal members are formed from a natural or synthetic resilient material.

10. The rocker arm assembly of claim 1 wherein a pair of bearing assemblies are positioned between the support member and the rocker arm to pivotally support the rocker arm relative to the support member.

11. The rocker arm assembly of claim 10 wherein the bearing assemblies provide further sealing between the support member and the rocker arm.

12. A rocker arm assembly for mounting about a stud means, the rocker arm assembly comprising:

a rocker arm having opposed first and second lateral ends and a central bore between the first and second ends, the central bore having an internal surface;

a support member positioned within the rocker arm central bore and mounted on the stud means, the rocker arm configured to pivot about the support member, the support member having opposed lateral sides; and a seal member extending along each lateral side of the support member sealing each lateral side of the support member relative to the internal surface of the central bore;

wherein a first fluid channel extends in fluid communication between the rocker arm central bore and the rocker arm first lateral end and a second fluid channel extends in fluid communication between the rocker arm central bore and the rocker arm second lateral end; and wherein pivoting of the rocker arm relative to the support member causes the first and second fluid channels to move relative to the seal members thereby causing fluid contained by the seal members to be forced along the first and second fluid channels.

13. The rocker arm assembly of claim 12 wherein a transverse wall extends across the first fluid channel and thereby defines a fluid reservoir adjacent the rocker arm first lateral end.

14. The rocker arm assembly of claim 13 wherein a transverse wall extends across the second fluid channel and thereby defines a fluid reservoir adjacent the rocker arm second lateral end.

15. The rocker arm assembly of claim 12 wherein a series of angled steps extends across the first fluid channel, the steps having face surfaces directed toward the rocker arm first lateral end such that fluid traveling from the central bore toward the rocker arm first lateral end is generally unimpeded and a portion of oil attempting to travel from the rocker arm first lateral end toward the central bore is prevented by the face surfaces.

16. The rocker arm assembly of claim 15 wherein a series of angled steps extends across the second fluid channel, the steps having face surfaces directed toward the rocker arm second lateral end such that fluid traveling from the central bore toward the rocker arm second lateral end is generally unimpeded and a portion of oil attempting to travel from the rocker arm second lateral end toward the central bore is prevented by the face surfaces.

17. The rocker arm assembly of claim 12 wherein the seal members are formed integral with the support member.

18. The rocker arm assembly of claim 12 wherein the seal members are formed from a natural or synthetic resilient material.

19. The rocker arm assembly of claim 12 wherein a pair of bearing assemblies are positioned between the support member and the rocker arm to pivotally support the rocker arm relative to the support member.

20. The rocker arm assembly of claim 19 wherein the bearing assemblies provide further sealing between the support member and the rocker arm.

21. A rocker arm assembly for mounting about a stud means, the rocker arm assembly comprising:

a rocker arm having opposed first and second lateral ends and a central bore between the first and second ends, the central bore having an internal surface;

a support member positioned within the rocker arm central bore and mounted on the stud means, the rocker arm configured to pivot about the support member, the support member having opposed lateral sides; and a seal member extending along each lateral side of the support member sealing each lateral side of the support member relative to the internal surface of the central bore;

wherein a first fluid channel extends in fluid communication between the rocker arm central bore and the rocker arm first lateral end and a second fluid channel extends in fluid communication between the rocker arm central bore and the rocker arm second lateral end; and wherein a series of angled steps extends across the first fluid channel, the steps having face surfaces directed toward the rocker arm first lateral end such that fluid traveling from the central bore toward the rocker arm first lateral end is generally unimpeded and a portion of oil attempting to travel from the rocker arm first lateral end toward the central bore is prevented by the face surfaces.

22. The rocker arm assembly of claim 21 wherein a series of angled steps extends across the second fluid channel, the steps having face surfaces directed toward the rocker arm second lateral end such that fluid traveling from the central bore toward the rocker arm second lateral end is generally unimpeded and a portion of oil attempting to travel from the rocker arm second lateral end toward the central bore is prevented by the face surfaces.

* * * * *